US011388928B2

(12) United States Patent
Besso

(10) Patent No.: US 11,388,928 B2
(45) Date of Patent: Jul. 19, 2022

(54) SMOKING ARTICLE WITH REDUCED SIDESTREAM SMOKE

(71) Applicant: PHILIP MORRIS PRODUCTS S.A., Neuchatel (CH)

(72) Inventor: Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 278 days.

(21) Appl. No.: 15/761,241

(22) PCT Filed: Sep. 29, 2016

(86) PCT No.: PCT/EP2016/073341

§ 371 (c)(1),
(2) Date: Mar. 19, 2018

(87) PCT Pub. No.: WO2017/055500

PCT Pub. Date: Apr. 6, 2017

(65) Prior Publication Data

US 2018/0271143 A1 Sep. 27, 2018

(30) Foreign Application Priority Data

Sep. 30, 2015 (EP) ..... 15187773

(51) Int. Cl.
*A24D 3/04* (2006.01)
*A24D 1/02* (2006.01)
(Continued)

(52) U.S. Cl.
CPC ..... *A24D 3/04* (2013.01); *A24D 1/025* (2013.01); *A24D 1/045* (2013.01); *A24D 3/0291* (2013.01); *A24D 3/043* (2013.01)

(58) Field of Classification Search
CPC ..... A24D 3/043
(Continued)

(56) References Cited

U.S. PATENT DOCUMENTS 1,983,530 A * 12/1934 Brandenberger ..... A24D 1/02 131/365
4,878,507 A 11/1989 Case
(Continued)

FOREIGN PATENT DOCUMENTS

CN 1031793 3/1989
CN 2220167 2/1996
(Continued)

OTHER PUBLICATIONS https://www.pmi.com/glossary-section/glossary/aerosol (Year: 2020).*
(Continued)

*Primary Examiner* — Michael J Felton
(74) *Attorney, Agent, or Firm* — Mueting Raasch Group

(57) ABSTRACT

A smoking article (10) comprises a tobacco rod (12) and a filter (14) connected to the tobacco rod. The filter (14) comprises a flow restrictor (24). The smoking article further comprises a ventilation zone (18) at a location along the filter downstream of the flow restrictor. The diameter of the tobacco rod (12) is from about 5 mm to about 8.5 mm, the tobacco packing density within the tobacco rod is from about 180 mg/cubic centimetre to about 280 mg/cubic centimetre, and the length of the tobacco rod is from about 15 mm to about 45 mm. Further, the tobacco rod (12) is circumscribed by a wrapper (13) having an air permeability of less than about 20 Coresta units, the wrapper being made of a transparent regenerated cellulose film, or cellophane.

24 Claims, 2 Drawing Sheets

Figure 1:
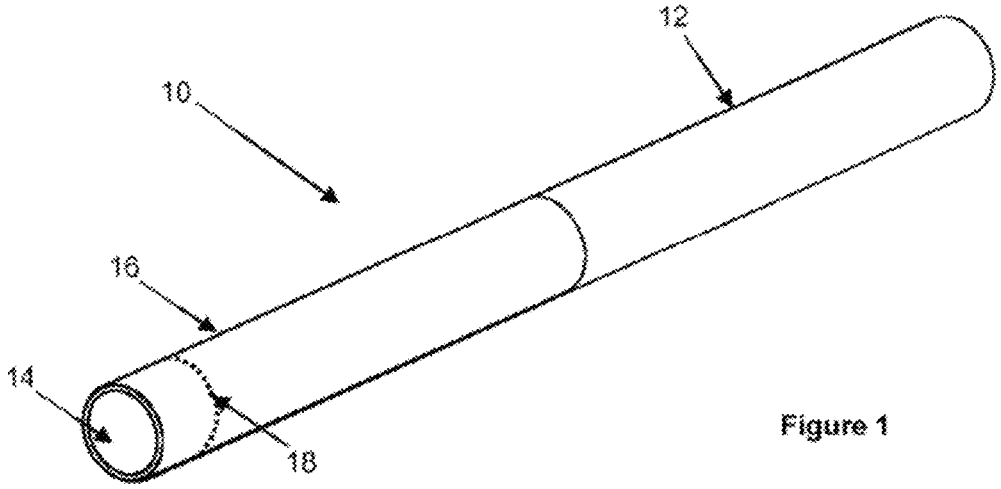

(51) Int. Cl.
*A24D 1/04* (2006.01)
*A24D 3/02* (2006.01)

(58) Field of Classification Search
USPC ..... 131/336
See application file for complete search history.

(56) References Cited

U.S. PATENT DOCUMENTS

| | | | | |
|---|---|---|---|---|
| 4,942,888 | A * | 7/1990 | Montoya | A24D 1/02 131/359 |
| 5,404,890 | A | 4/1995 | Gentry | |
| 5,474,095 | A * | 12/1995 | Allen | D21H 21/34 131/365 |
| 5,551,451 | A * | 9/1996 | Riggs | A24F 47/004 131/359 |
| 5,568,819 | A | 10/1996 | Gentry | |
| 6,779,530 | B2 | 8/2004 | Kraker | |
| 8,807,143 | B2 | 8/2014 | Fiebekorn | |
| 8,955,524 | B2 | 2/2015 | White | |
| 10,342,254 | B2 | 7/2019 | Nappi | |
| 2004/0007242 | A1 | 1/2004 | Finlay | |
| 2006/0027243 | A1 | 2/2006 | Matsufuji | |
| 2006/0150991 | A1 | 7/2006 | Lee | |
| 2007/0235050 | A1 | 10/2007 | Li | |
| 2008/0168998 | A1 | 7/2008 | Badertscher | |
| 2008/0216848 | A1 | 9/2008 | Li | |
| 2008/0216853 | A1 | 9/2008 | Li | |
| 2010/0288293 | A1 | 11/2010 | Jordil | |
| 2011/0088704 | A1* | 4/2011 | Lipowicz | A24D 1/00 131/88 |
| 2013/0199550 | A1* | 8/2013 | Ono | A24C 5/472 131/280 |
| 2015/0296877 | A1* | 10/2015 | Nappi | A24D 3/045 131/336 |
| 2016/0120213 | A1* | 5/2016 | Ademe | A24C 5/3424 131/281 |

FOREIGN PATENT DOCUMENTS

| | | |
|---|---|---|
| CN | 1662157 | 8/2005 |
| CN | 1774184 | 5/2006 |
| CN | 201069996 | 6/2008 |
| CN | 104902769 | 9/2015 |
| EP | 2253231 | 11/2010 |
| EP | 2693902 | 2/2014 |
| EP | 2740370 | 6/2014 |
| EP | 2858519 | 4/2015 |
| EP | 3355726-WO 2017/055500 | 8/2018 |
| JP | H05-45198 U | 6/1993 |
| JP | H07-67613 | 12/1994 |
| JP | 2005-523389 | 8/2005 |
| JP | 2006-517106 | 7/2006 |
| JP | 2009-531052 | 9/2009 |
| JP | 2012-527221 | 11/2010 |
| JP | 2011-69040 | 4/2011 |
| JP | 2014-528711 | 10/2014 |
| RU | 2520878 | 1/2013 |
| RU | 140556 | 5/2014 |
| WO | WO 2007/110650 | 10/2007 |
| WO | WO 2010/133334 | 11/2010 |
| WO | WO 2013/021863 | 2/2013 |
| WO | WO 2013/034512 | 3/2013 |
| WO | WO 2013/079645 | 6/2013 |
| WO | WO 2014/012841 | 1/2014 |
| WO | WO 2014/102095 | 7/2014 |

OTHER PUBLICATIONS

PCT Search Report and Written Opinion for PCT/EP2016/073341 dated Dec. 12, 2016 (9 pages).
European Extended Search Report for Application No. 15187773.5 dated Mar. 14, 2016 (7 pages).
Office Action issued in Russia for Application No. 2018115729 dated Sep. 26, 2019 (16 pages). English translation included.
Office Action issued in China for Application No. 201680053395.9 dated Apr. 23, 2020 (13 pages). English translation included.
Office Action issued in Europe for Application No. 19203419.7 dated May 11, 2020 (11 pages).
Office Action issued in Japan for Application No. 2018-515800 dated Oct. 29, 2020 (12 pages). English translation included.
Office Action issued in Japan for Application No. 2018-515800 dated Apr. 5, 2021 (8 pages). English translation included.

* cited by examiner

SMOKING ARTICLE WITH REDUCED SIDESTREAM SMOKE

This application is a U.S. National Stage Application of International Application No. PCT/EP2016/073341, filed Sep. 29, 2016, which was published in English on Apr. 6, 2017, as International Publication No. WO 2017/055500 A1. International Application No. PCT/EP2016/073341 claims priority to European Application No. 15187773.5 filed Sep. 30, 2015.

The present invention relates to a smoking article including a tobacco rod and a filter element.

Combustible smoking articles, such as cigarettes, generally comprise shredded tobacco (usually in cut filler form) surrounded by a paper wrapper to form a cylindrical tobacco rod and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping paper. A cigarette is employed by a consumer by lighting one end thereof and burning the shredded tobacco rod. The consumer then receives mainstream smoke by drawing on the opposite end (mouth end or filter end) of the cigarette.

Smoking articles having a cavity at the mouth end of their filter section have also been proposed. Further, the incorporation into the filter section of an element adapted to restrict flow of the mainstream smoke is also known.

In smoking articles, as the combustible substrate continues to burn between puffs (or, in those smoking articles where the tobacco is heated, where the aerosol-forming substrate is heated between puffs) smoke (or aerosol) may form leading to visible sidestream smoke when the user is not puffing on the smoking article. This is socially objectionable in that the continuously burning smoking article emits undesirable smoke smell around the consumer.

It would be desirable to provide a smoking article having reduced side-stream smoke. Further, it would be desirable to provide such a smoking article while, at the same time, ensuring satisfactory values of RTD, airflow, and CO levels for the consumer. Additionally, it would be desirable to provide a smoking article that enables a reduction in the usage of tobacco cut filler for the manufacture of smoking articles.

Accordingly, the present invention provides a smoking article comprising a tobacco rod and a filter connected to the tobacco rod. The filter comprises a flow restrictor. The smoking article further comprises a ventilation zone at a location along the filter downstream of the flow restrictor. The diameter of the tobacco rod is from about 5 mm to about 8.5 mm, the tobacco packing density within the tobacco rod is from about 180 mg/cubic centimetre to about 280 mg/cubic centimetre, the length of the tobacco rod is from about 15 mm to about 45 mm. Further, the tobacco rod is circumscribed by a wrapper having an air permeability of less than about 20 Coresta units.

The terms "upstream" and "downstream" are used herein to describe the relative positions of elements, or portions of elements, of the smoking article in relation to the direction in which a consumer draws on the smoking article during use thereof. Smoking articles as described herein comprise a downstream end and an opposed upstream end. In use, a consumer draws on the downstream end of the smoking article. The downstream end, which is also described as the mouth end, is downstream of the upstream end, which may also be described as the distal end.

The expression "overall length of the smoking article" is used throughout this specification to refer to the sum of the lengths of the various components forming the smoking article. Thus, the expression "overall length of the smoking article" should be construed as referring substantially to the sum of the length of the tobacco rod and the length of the filter measured longitudinally. In practice, the "overall length of the smoking article" may also be measured between the upstream end of the smoking article and the mouth end of the smoking article.

The "Coresta unit" is the unit of air permeability of a sheet material, which corresponds to the flow of air (cubic centimetres per minute) passing through a 1 square centimetre surface area of the test material at a measuring pressure of 1.00 kPa. The measuring pressure is the difference in pressure between the two faces of the test material during measurement. As such, the units corresponding to the Coresta unit are cubic centimetres per minute per square centimetre ($cm^3$ min' cm') at 1.00 kPa. A suitable method for determining the air permeability of sheet materials for use in the present invention is described in ISO Standard 2965: 2009.

The air permeability in Coresta units (CU) for a test piece is calculated using the formula:

$$CU=[Q/A]\times[1/d]$$

where Q is the measured air flow, in cubic centimetres per minute, passing through the test piece, A is the surface area, in square centimetres, of the test piece, and d is the actual measure of pressure difference, in kilopascals, across the two surfaces of the test piece.

Further, the term "substantially impermeable" is used throughout this specification to describe a cigarette wrapper that allows less than 5% dilution of the mainstream smoke through the ingress of ambient air into the rod and the filter. The substantially air impermeable sheet material may be non-porous. The substantially air impermeable sheet material may optionally include perforations. In practice, a "substantially impermeable wrapper" has an air permeability of less than 20 Coresta units, preferably less than 10 Coresta units, and more preferably less than 5 Coresta units. In some preferred embodiments, the air permeability of the substantially impermeable wrapper can have a lower limit of 1 Coresta unit.

According to the present invention, a shortened tobacco rod is formed and circumscribed by a wrapper having very low gas permeability. This is in contrast to known smoking articles and standard cigarettes such as the reference cigarette 3R4F (University of Kentucky, USA). Further, a filter including a flow restrictor element is attached to the shortened tobacco rod. A ventilation zone is provided in the filter at a location downstream of the flow restrictor, such that ambient air can be drawn into the filter when the consumer puffs on the smoking article. At the upstream end, in contrast, ambient air is substantially prevented from entering the non-ventilated tobacco rod, particularly when the consumer is not puffing on the smoking article.

As a result of the use of low-air permeability cigarette wrapper paper, sustained, smouldering combustion of the tobacco rod between puffs is reduced, or substantially inhibited. In turn, the formation of sidestream smoke is significantly decreased, compared with smoking articles currently on the market. This configuration is also advantageous in that, because a lesser amount of tobacco is combusted to form sidestream smoke in the time period between puffs made by the consumer, a smoking article that is expected to provide the same number of puffs as a standard smoking article in the current market can be manufactured with a lesser amount of tobacco than a standard smoking article.

As a lesser amount of ambient air enters the tobacco rod during its combustion, the quantity of carbon monoxide (CO) produced may increase relative to standard smoking articles. To counter this effect, the smoking article of the invention provides in the filter a flow restrictor in the tube segment of the filter in combination with a downstream ventilation zone. By adjusting the length of the tobacco rod relative to the overall length of the smoking article, it has been found that the resistance to draw (RTD), CO and tar levels of the smoking article can be tailored to satisfy the consumer and to meet regulatory standards.

During experimentation, smoking articles according to the present invention have been found to behave in a manner comparable to self-extinguishing smoking articles, if too much time lapses between consecutive puffs. The smoking article of the invention tends to stop burning when compared to a standard smoking article in the market which continues to smoulder and generate sidestream smoke. To keep a conventional smoking article burning, the average time between puffs is about 20 to 60 seconds. Consumers may, therefore, choose to puff more frequently on a smoking article according to the invention than they would on conventional smoking articles. In this case, the consumer would make the same number of puffs, about 8 to 9 puffs, in a shorter time period than a conventional smoking article resulting in a quick smoking experience, which is estimated to be about 4 to 5 minutes in total. If the consumer does not make frequent puffs, the smoking article of the invention begins to lack oxygen to support combustions and starts to self-extinguish. The smoking article of the invention may thus need to be lit again and, as a result, the consumer would take essentially the same number of puffs as a standard smoking article, but with a longer pause between each puff. In either situation, because combustion is substantially inhibited between puffs, little or no tobacco is wasted to the formation of sidestream smoke. Accordingly, the amount of tobacco burnt between puffs in the smoking article of the invention is between about 6 to about 15 mg, compared to about 60 mg of tobacco burnt in a standard cigarette. The amount of tobacco burnt between puffs in the smoking article of the invention is about 10% to 25% of that of a standard cigarette.

To simulate a consumer smoking of a smoking article, the smoking article is subjected to a standard smoking test under ISO conditions (for example, 35 ml puffs lasting 2 seconds each, every 60 seconds). In the ISO test method, the smoking article is smoked with the ventilation zone fully uncovered.

In smoking articles according to the present invention, the amount of tobacco packed into each smoking article of the invention resembles that of a standard cigarette, which ranges from about 180 mg/cubic centimetre to about 280 mg/cubic centimetre, preferably from about 220 mg/cubic centimetre to about 265 mg/cubic centimetre.

In some embodiments, the diameter of the tobacco rod is from about 5 mm to about 7 mm and the length of the tobacco rod is from about 35 to about 45 mm. In a particularly preferred embodiment, the diameter of the tobacco rod is about 5.4 mm and the length of the tobacco rod is about 42 mm. This is particularly desirable in the it provides the consumer with a smoking article that has the visual impact of a shortened 'super slim' cigarette whilst presenting the innovative combustion behaviour described above.

In alternative embodiments, the diameter of the tobacco rod is from about 7 mm to about 8 mm and the length of the tobacco rod is from about 15 mm to about 25 mm. In a particularly preferred embodiment, the diameter of the tobacco rod is about 7.8 mm and the length of the tobacco rod is about 20 mm. This is particularly desirable in the it provides the consumer with a smoking article that has the visual impact of a shortened 'standard' cigarette whilst presenting the innovative combustion behaviour described above.

In other alternative embodiments, the diameter of the tobacco rod is from about 7.5 mm to about 8.5 mm and the length of the tobacco rod is from about 12 mm to about 22 mm. In a particularly preferred embodiment, the diameter of the tobacco rod is about 8.4 mm and the length of the tobacco rod is about 17 mm. This is particularly desirable in the it provides the consumer with a smoking article that has the visual impact of a shortened 'magnum' cigarette whilst presenting the innovative combustion behaviour described above.

In smoking articles according to the present invention, the tobacco rod is circumscribed by a wrapper having a very low air permeability, namely a permeability of less than about 20 Coresta units. Preferably, the wrapper has an air permeability of less than about 10 Coresta units. Preferably, the wrapper has an air permeability of less than about 5 Coresta units. In other words, the wrapper is preferably substantially air impermeable.

In a preferred embodiment, the wrapper is made of a thin, transparent, regenerated cellulose film that exhibits low permeability to air and water, such as cellophane (Innovia Films, Wigton, United Kingdom). The use of cellophane is advantageous in that not only it provides for the desirably low level of air permeability, but also because it shrinks in the presence of heat, such as with the burning coal. Thus, when the smoking article is lit and smoked, a cellophane wrapper shrinks slightly around the upstream end of the tobacco rod, to assume a bullet shape. Without wishing to be bound to theory, this is understood to further reduce the permeable surface area available for ambient air to ingress the smoking article and, consequently, to further hinder smouldering and the formation of sidestream smoke. Further, because cellophane is transparent, a smoking article allowing the consumer to view the tobacco material inside the rod can be provided.

As an alternative, the wrapper may be made of any other material adapted to substantially prevent the ingress of ambient air into the circumscribed tobacco rod. In practice, the wrapper may be made of other special papers that are substantially comparable with cellophane in terms of air permeability.

By way of example, the wrapper may be made from a substantially non-porous paper or from paper that has been treated with salts adapted to reduce its burn rate, or from a paper charged with fire retardant. In practice, the wrapper may comprise a base web and one or more layers of add-on material applied to the base web, for example by printing, adapted to reduce its static burn rate. Various salts suitable for reducing the static burn rate of the wrapper may be used, such as alkali metal salts.

In addition or as an alternative, the base web may be treated (for example, printed) with an add-on material adapted to reduce its porosity and air permeability. In some embodiments, the base web may be treated (for example, printed) with an aqueous or non-aqueous starch solution that includes an anti-wrinkling agent. In other embodiments, the base web may be treated (for example, printed) with an aqueous or non-aqueous solution comprising a mixture of calcium carbonate (or chalk) particles, starch, and an anti-wrinkling agent. Many types of starch may be used, with tapioca starch being a preferred starch component. Similarly, many types of calcium carbonate particles may be used. Various anti-wrinkling agents are suitable to attain the desired characteristics described herein. In particular, the anti-wrinkling agent may be selected from the group consisting of glycerin, propylene glycol, and 1,2 propylene glycol. Thus, air permeability of the wrapper may be advantageously tailored to be less than about 20 Coresta units. Accordingly, these wrappers advantageously behave, for the purposes of the present invention, substantially as cellophane.

The tobacco rod typically comprises a charge of tobacco circumscribed by a paper wrapper. The tobacco rod may comprise any suitable type or types of tobacco material or tobacco substitute, in any suitable form. Preferably, the tobacco rod includes flue-cured tobacco, Burley tobacco, Maryland tobacco, Oriental tobacco, rare tobacco, specialty tobacco, or any combination thereof. Preferably, the tobacco is provided in the form of tobacco lamina, processed tobacco materials, such as volume expanded or puffed tobacco, processed tobacco stems, such as cut-rolled or cut-puffed stems, reconstituted tobacco materials, blends thereof, and the like. In preferred embodiments, the tobacco is in the form of cut filler, that is, in the form of shreds or strands cut into widths ranging from about 2.5 mm to about 1.2 mm or even about 0.6 mm. Preferably, the length of the strands ranges from about 6 mm to about 75 mm.

Preferably, the tobacco rod has a length of less than about 50 percent of the overall length of the smoking article. More preferably, the tobacco rod has a length of less than about 40 percent of the overall length of the smoking article.

Because of the presence of the flow restrictor element, in smoking articles according to the present invention the mainstream smoke is diverted to flow through a passageway having reduced cross-sectional area. Accordingly, the flow restrictor advantageously increases the RTD to a level that is acceptable to a consumer.

In some embodiments of smoking articles according to the present invention, the filter comprises a segment that comprises a hollow tube defining a cavity at the mouth end of the filter, and a flow restrictor disposed in the cavity. In another embodiment, in addition to the hollow tube segment, the filter may comprises one or more additional segments. The flow restrictor element may thus be arranged in the cavity defined by the hollow tube segment. In these embodiments, the flow restrictor diverts the flow of air and smoke towards the periphery of the hollow tube and directs the flow of air and smoke to flow around the flow restrictor.

As an alternative, the flow restrictor element may be arranged within a segment of filtration material of the filter. By way of example, the flow restrictor element may be surrounded on all sides by the filtration material.

The flow restrictor may be solid or may comprise a shell and a core. The core may be empty. The flow restrictor may have any suitable shape. For example, the flow restrictor may be substantially ovoid, ellipsoid, spheroid, cylindrical, prism-shaped or teardrop-shaped. In a preferred embodiment, however, the flow restrictor is substantially spherical. A spherical flow restrictor is easy to manufacture and, since it is radially symmetrical, its orientation within the hollow tube is not important.

The flow restrictor preferably comprises an air-impervious material. The expression "air-impervious material" is used throughout this specification to mean a material not allowing the passage of fluids, particularly air and smoke, through interstices or pores in the material. If the flow restrictor comprises a material impermeable to air and smoke, air and smoke drawn through the filter are forced to flow around the flow restrictor and through a passageway of reduced cross section.

The hollow tube segment has an outer diameter and an inner diameter. In some embodiments, at least one cross sectional dimension of the flow restrictor is preferably larger than the inner diameter of the hollow tube such that the flow restrictor engages with the hollow tube to be retained in the hollow tube. Where the flow restrictor is substantially spherical, the at least one cross sectional dimension of the flow restrictor is a diameter of the spherical flow restrictor.

The longitudinal position of the centre of the flow restrictor in the hollow tube may be selected to adjust the level of RTD. For example, the longitudinal position of the centre of the flow restrictor may be at least about 6 mm from the mouth end of the filter. In this context, the "centre" of the flow restrictor refers to the mid-point between the part of the flow restrictor disposed closest to the downstream end of the filter and the part of the flow restrictor disposed closest to the upstream end of the filter.

In other embodiments, the flow restrictor may comprise a transverse barrier extending across the hollow tube segment, at least one orifice being provided in the transverse barrier for the mainstream smoke to flow through. The mainstream smoke is thus diverted to flow through a passageway having reduced cross-sectional area, and the RTD is accordingly increased to a level that is acceptable to a consumer.

Preferably, the flow restrictor comprises a first upstream integral tubular portion; a second downstream integral tubular portion of substantially the same external diameter as the first tubular portion; and a third central integral tubular portion located between the first and second tubular portions, the third tubular portion being of reduced external diameter compared to the first and second tubular portions. The transverse barrier having the at least one orifice is disposed between a first upstream cavity at least partially defined by an inner periphery of the first tubular portion and a second downstream cavity at least partially defined by an inner periphery of the second tubular portion. More preferably, the transverse barrier extends across the third central integral tubular portion.

The flow restrictor may be able to generate a RTD of at least about 150 mm $H_2O$ (about 1470 Pa), preferably at least about 200 mm $H_2O$ (about 1960 Pa), even more preferably at least about 250 mm $H_2O$ (about 2450 Pa). Alternatively or in addition, the flow restrictor may be able to generate a RTD of less than about 500 mm $H_2O$ (about 4900 Pa), preferably less than least about 400 mm $H_2O$ (about 3920 Pa), even more preferably less than about 350 mm $H_2O$ (about 3430 Pa). In some preferred embodiments, the flow restrictor generates a RTD between approximately 150 mm $H_2O$ (about 1470 Pa) and 400 mm $H_2O$ (about 3920 Pa). In some particularly preferred embodiments, the flow restrictor generates a RTD of approximately 325 mm $H_2O$ (about 3185 Pa).

The RTD generated by the flow restrictor may be assessed as the negative pressure that has to be applied, under test conditions as defined in ISO 3402, to the output end of the filter section containing the hollow tube with the restrictor, in order to sustain a steady volumetric flow of air of 17.5 ml/s through the filter section, having blocked any ventilation off. In the context of this application, if the filter comprises any filter segments other than the one containing the hollow tube with the restrictor, those are removed prior to carrying out the measurement.

Preferably, the wall thickness of the hollow tube segment is at least about 90 micrometres. More preferably, the wall thickness of the hollow tube segment is at least about 100 micrometres. Alternatively, or in addition, the wall thickness of the hollow tube segment is less than about 140 micrometres. Preferably, the wall thickness of the hollow tube segment is less than about 130 micrometres. In some preferred embodiments, the wall thickness of the hollow tube segment is from about 90 micrometres to about 140 micrometres, preferably from 100 micrometres to 130 micrometres.

The hollow tube may comprise any suitable material or materials. In some preferred embodiments, the hollow tube may comprise a filter material selected to provide the desired level of RTD. Examples of suitable materials include, but are not limited to, cellulose acetate, cellulose, reconstituted cellulose, polylactic acid, polyvinyl alcohol, nylon, polyhydroxybutyrate, thermoplastic material, such as starch, formed into an open cell foam, and combinations thereof. All or part of the filter may include activated carbon. The filter may include an adhesive or plasticiser or a combination thereof to assist with retaining the flow restrictor in the hollow tube. This may also assist with inserting the flow restrictor into the hollow tube during manufacture. The filter material may be compressible, to allow the flow restrictor to be inserted into the hollow tube.

Preferably, the filter material of the hollow tube is of low particulate efficiency. Preferably, the hollow tube comprises fibres of between approximately 1.5 denier per filament (dpf) and approximately 12.0 dpf. In a preferred embodiment, the hollow tube comprises medium diameter fibres of approximately 3.3 dpf. Preferably, the hollow tube comprises fibres of between approximately 15000 total denier (td) and approximately 50000 td. In a preferred embodiment, the hollow tube comprises medium diameter fibres of approximately 44000 td.

As an alternative, the hollow tube may preferably be formed from a paper material. More preferably, the hollow tube segment is formed from a plurality of overlapping paper layers, such as a plurality of parallel wound paper layers or a plurality of spirally wound paper layers. Forming the hollow tube segment from a plurality of overlapping paper layers can help to improve resistance to collapse or deformation.

Preferably the hollow tube segment comprises at least two paper layers. Alternatively, or additionally, the hollow tube segment preferably comprises fewer than eleven paper layers. An exemplary method for forming a tube segment from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

The filter may further include a filter wrapper circumscribing the segment comprising the hollow tube. A filter wrapper provides strength and structural rigidity for the hollow tube. This reduces the chance that the hollow tube will deform or be damaged as the flow restrictor is inserted into the hollow tube. This also reduces the chance that the hollow tube will deform on its outer surface around the region where the flow restrictor is disposed inside the hollow tube. Preferably, if the filter includes one or more additional filter elements, the hollow tube and the one or more additional filter elements are overwrapped with a filter wrapper.

The filter wrapper may comprise any suitable material. Preferably, the filter wrapper is a plug wrap of increased stiffness, for example comprising stiff paper or cardboard. The stiff paper or cardboard preferably has a basis weight greater than about 60 g/square m. A stiff filter wrapper provides high structural rigidity. The filter wrapper may include a seam including one or more lines of adhesive. Preferably, the seam includes two lines of adhesive. This reduces the chance that the filter wrapper will split open as the flow restrictor is inserted into the hollow tube. One line of adhesive may comprise a hot melt adhesive. One line of adhesive may comprise polyvinyl alcohol.

Preferably, the filter has a length of at least about 15 mm. Even more preferably, the filter has a length of at least about 18 mm. Alternatively, or in addition, the filter has preferably a length of less than about 40 mm, even more preferably less than about 35 mm. In one embodiment, the filter has a length of about 27 mm. Where the filter comprises no additional component other than the hollow tube segment, the length of the filter coincides with the length of the hollow tube segment.

In smoking articles according to the present invention, a ventilation zone is provided at a location along the filter downstream of the flow restrictor. In embodiments comprising a hollow tube segment defining a cavity, the ventilation zone is in communication with the cavity. The ventilation, in conjunction with the flow restrictor, produces the desired level of RTD. Preferably, the ventilation zone comprises at least one circumferential row of perforations provided through the hollow tube segment. In some preferred embodiments, the ventilation zone comprises two circumferential rows of perforations provided through the hollow tube segment. For example, the perforations may be formed online during manufacture of the smoking article. Preferably, each circumferential row of perforations comprises from 8 to 30 perforations.

Preferably, particularly in embodiments where the flow restrictor is disposed in the hollow tube so as to divert the flow of air and smoke towards the periphery of the hollow tube and directed to flow around the flow restrictor, the at least one circumferential row of perforations is at least about 1 mm downstream of the centre of the flow restrictor. More preferably, the at least one circumferential row of perforations is at least about 3 mm downstream of the centre of the flow restrictor. Most preferably, the ventilation zone is placed downstream of the flow restrictor such that the ventilation air is introduced into a cavity defined within the hollow tube downstream of the flow restrictor. This provides the optimal mix of ambient air drawn through the perforations and the air and smoke mixture flowing through the filter.

In a corresponding manner, in embodiments where the flow restrictor comprises a transverse barrier extending across the hollow tube, the at least one circumferential row of perforations is at least about 1 mm downstream of the transverse barrier. More preferably, the at least one circumferential row of perforations is at least about 3 mm downstream of the transverse barrier. Most preferably, the ventilation zone is placed downstream of the transverse barrier, such that ventilation air is introduced into a cavity defined within the hollow tube downstream of the transverse barrier.

Preferably, the ventilation zone is located at least about 2 mm upstream from the mouth end of the filter. More preferably, the ventilation zone is located at least about 5 mm upstream from the mouth end of the filter. This advantageously makes it less likely for the consumer to obstruct the ventilation zone when holding the smoking article with his or her lips. Preferably, the ventilation zone is located at least about 10 mm upstream from the mouth end of the filter.

In addition, or as an alternative, the ventilation zone is preferably located less than about 20 mm upstream from the mouth end of the filter. More preferably, the ventilation zone is preferably located less than about 15 mm upstream from the mouth end of the filter. In some preferred embodiments, the ventilation zone is preferably located from about 2 to 20 mm upstream from the mouth end of the filter. In some more preferred embodiments, the ventilation zone is preferably located from about 10 to 15 mm upstream from the mouth end of the filter. This provides an appropriate length of hollow tube for ventilation air and mainstream smoke to mix before they reach the mouth end of the smoking article.

To connect the filter to the tobacco rod, the smoking article may include a band of tipping wrapper circumscribing the filter and at least a portion of the tobacco rod. The tipping wrapper may comprise paper having a basis weight of less than about 70 gsm, preferably less than about 50 gsm. The tipping wrapper preferably has a basis weight of more than about 20 gsm. Thus, the tipping wrapper may provide additional strength and structural rigidity for the filter and reduce the chance of deformation on the outer surface of the filter at the location where the flow restrictor is disposed in the hollow tube of filter material.

The tipping wrapper may include a ventilation zone comprising perforations through the tipping wrapper, located substantially in alignment with the perforations in the hollow tube segment. The tipping wrapper may be a standard pre-perforated tipping wrapper. Alternatively, the tipping wrapper may be perforated (for example, using a laser) during the manufacturing process according to the desired number, size and position of the perforations.

The smoking article described above can be assembled using standard manufacturing equipment. The flow restrictor may be manufactured off-line, for example using a fast continuous process such as a rotary-die process. An object inserting machine may be used for inserting the flow restrictor inside the hollow tube. Other parts of the smoking article, such as the tobacco rod, can be manufactured according to standard processes using standard manufacturing equipment.

Figure 2A:
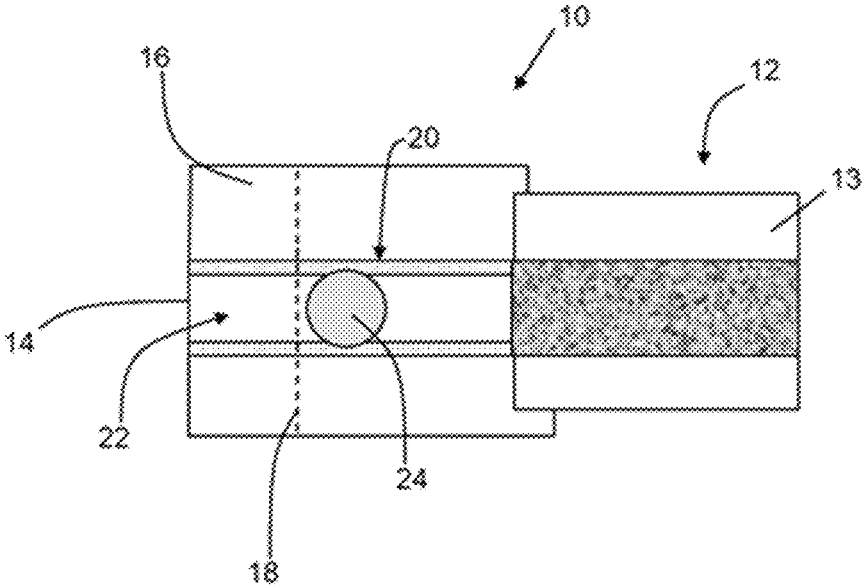
Figure 2B:
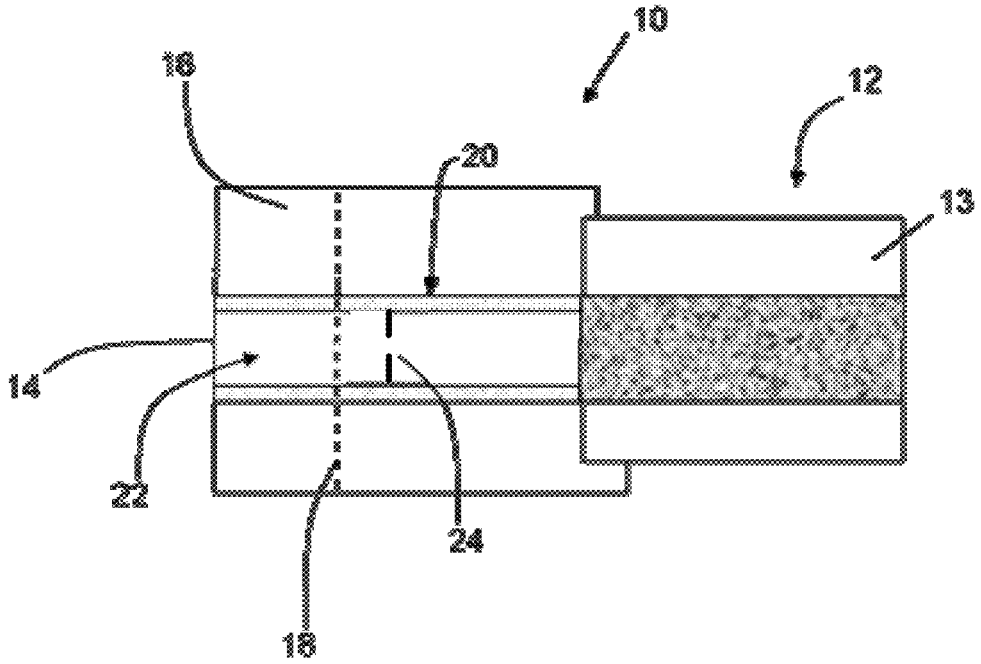

The invention will be further described, by way of example only, with reference to the accompanying drawings in which:

FIG. 1 shows a smoking article in accordance with the present invention; and FIGS. 2A and 2B show a side sectional view of the smoking article of FIG. 1 with the filter and rod unwrapped.

FIGS. 1 and 2 illustrate a smoking article 10 in accordance with the present invention. The smoking article 10 comprises a rod 12 of tobacco cut filler which is attached at one end to an axially aligned filter 14. The tobacco rod 12 is circumscribed by a wrapper 13 (see FIG. 2) made of cellophane and has a length of about 20 mm. The diameter of the tobacco rod 12 is about 7.8 mm. The packing density of the tobacco within the tobacco rod 12 is about 265 mg/cubic centimetre. A band of tipping paper 16 circumscribes the filter 14 and a portion of the wrapped tobacco rod 12 to join together the filter 14 and the rod 12.

The smoking article 10 further comprises a ventilation zone 18 at a location along the filter 14. Although not visible in FIG. 1, a flow restrictor is disposed in the filter 14. The filter 14 has a length of about 27 mm.

In more detail, as illustrated in FIG. 2, the filter 14 comprises a hollow tube segment 20 that defines a cavity 22 at the mouth end of the filter 14. A flow restrictor 24 is disposed within the cavity 22. The ventilation zone 18 is located downstream of the flow restrictor 24.

In the embodiment of FIG. 2A, the hollow tube segment 20 is made of filter material. The flow restrictor 24 is provided as a substantially spherical bead. The diameter of the bead 24 is slightly larger than the inner diameter of the hollow tube segment 20, so the bead 24 causes the filter material adjacent the bead 24 to distort slightly and the bead 24 is retained in the hollow tube segment 20 by friction.

In the embodiment of FIG. 2B. The flow restrictor 24 comprises a transverse barrier with at least one orifice in the barrier.

The invention claimed is:

1. A smoking article comprising a tobacco rod and a filter connected to the tobacco rod, the filter comprising a hollow tube segment defining a cavity at the mouth end of the filter and a flow restrictor disposed in the cavity, the smoking article further comprising a ventilation zone at a location along the filter downstream of the flow restrictor, the ventilation zone being in communication with the cavity;

wherein a diameter of the tobacco rod is from 7 mm to 8 mm, a tobacco packing density within the tobacco rod is from 180 mg/cubic centimetre to 280 mg/cubic centimetre, and a length of the tobacco rod is from 15 mm to 25 mm;

wherein a wall thickness of the hollow tube segment is less than 140 micrometres; and wherein the tobacco rod is circumscribed by a wrapper having an air permeability of less than 20 Coresta units.

2. The smoking article according to claim 1, wherein the wrapper is substantially air impermeable.

3. The smoking article according to claim 1, wherein the wrapper comprises a base web and one or more layers of add-on material applied to the base web, wherein the add-on material reduces the static burn rate of the wrapper.

4. The smoking article according to claim 1, wherein the hollow tube segment has an outer diameter and an inner diameter, at least one cross sectional dimension of the flow restrictor being larger than the inner diameter of the hollow tube such that the flow restrictor engages with the hollow tube to be retained in the hollow tube.

5. The smoking article according to claim 4, wherein the flow restrictor is substantially spherical, the at least one cross sectional dimension of the flow restrictor being a diameter of the spherical flow restrictor.

6. The smoking article according to claim 1, wherein the flow restrictor comprises a transverse barrier extending across the hollow tube segment, at least one orifice being provided in the transverse barrier for the mainstream smoke to flow through.

7. The smoking article according to claim 6, wherein the flow restrictor comprises a first upstream integral tubular portion; a second downstream integral tubular portion of substantially the same external diameter as the first tubular portion; a third central integral tubular portion located between the first and second tubular portions, the third tubular portion being of reduced external diameter compared to the first and second tubular portions; wherein the transverse barrier is provided therein between a first upstream cavity at least partially defined by an inner periphery of the first tubular portion and a second downstream cavity at least partially defined by an inner periphery of the second tubular portion.

8. The smoking article according to claim 5, wherein the ventilation zone comprises at least one circumferential row of perforations at least 3 mm downstream of a centre of the flow restrictor.

9. The smoking article according to claim 6, wherein the ventilation zone comprises at least one circumferential row of perforations at least 3 mm downstream of the transverse barrier.

10. The smoking article according to claim 1, wherein the flow restrictor is adapted to generate a RTD between approximately 150 mm $H_2O$ (about 1470 Pa) and approximately 500 mm $H_2O$ (about 4900 Pa).

11. The smoking article according to claim 1, wherein the ventilation zone is at least 2 mm upstream from a mouth end of the filter.

12. The smoking article according to claim 1, wherein the ventilation zone is less than 20 mm upstream from a mouth end of the filter.

13. A smoking article comprising a tobacco rod and a filter connected to the tobacco rod, the filter comprising a hollow tube segment defining a cavity at the mouth end of the filter and a flow restrictor disposed in the cavity; the smoking article further comprising a ventilation zone at a location along the filter downstream of the flow restrictor, the ventilation zone being in communication with the cavity;

wherein the tobacco rod is circumscribed by a wrapper having an air permeability of less than 20 Coresta units;

wherein a wall thickness of the hollow tube segment is less than 140 micrometres; and wherein a diameter of the tobacco rod is from 5 mm to 7 mm, a tobacco packing density within the tobacco rod is from 180 mg/cubic centimetre to 280 mg/cubic centimetre, and a length of the tobacco rod is from 35 mm to 45 mm.

14. The smoking article according to claim 13, wherein the wrapper is substantially air impermeable.

15. The smoking article according to claim 13, wherein the wrapper comprises a base web and one or more layers of add-on material applied to the base web, wherein the add-on material reduces the static burn rate of the wrapper.

16. The smoking article according to claim 13, wherein the hollow tube segment has an outer diameter and an inner diameter, at least one cross sectional dimension of the flow restrictor being larger than the inner diameter of the hollow tube such that the flow restrictor engages with the hollow tube to be retained in the hollow tube.

17. The smoking article according to claim 16, wherein the flow restrictor is substantially spherical, the at least one cross sectional dimension of the flow restrictor being a diameter of the spherical flow restrictor.

18. The smoking article according to claim 13, wherein the flow restrictor comprises a transverse barrier extending across the hollow tube segment, at least one orifice being provided in the transverse barrier for the mainstream smoke to flow through.

19. The smoking article according to claim 18, wherein the flow restrictor comprises a first upstream integral tubular portion; a second downstream integral tubular portion of substantially the same external diameter as the first tubular portion; a third central integral tubular portion located between the first and second tubular portions, the third tubular portion being of reduced external diameter compared to the first and second tubular portions; wherein the transverse barrier is provided therein between a first upstream cavity at least partially defined by an inner periphery of the first tubular portion and a second downstream cavity at least partially defined by an inner periphery of the second tubular portion.

20. The smoking article according to claim 17, wherein the ventilation zone comprises at least one circumferential row of perforations at least 3 mm downstream of a centre of the flow restrictor.

21. The smoking article according to claim 18, wherein the ventilation zone comprises at least one circumferential row of perforations at least 3 mm downstream of the transverse barrier.

22. The smoking article according to claim 13, wherein the flow restrictor is adapted to generate a RTD between approximately 150 mm $H_2O$ (about 1470 Pa) and approximately 500 mm $H_2O$ (about 4900 Pa).

23. The smoking article according to claim 13, wherein the ventilation zone is at least 2 mm upstream from a mouth end of the filter.

24. The smoking article according to claim 13, wherein the ventilation zone is less than 20 mm upstream from a mouth end of the filter.

* * * * *